US009677521B2

(12) United States Patent
Graspeuntner

(10) Patent No.: US 9,677,521 B2
(45) Date of Patent: Jun. 13, 2017

(54) COMPONENT HAVING HIGH-PRESSURE BORES THAT LEAD INTO ONE ANOTHER

(71) Applicant: Robert Bosch GmbH, Stuttgart (DE)

(72) Inventor: Christian Graspeuntner, Hallein (AT)

(73) Assignee: ROBERT BOSCH GMBH, Stuttgart (DE)

( * ) Notice: Subject to any disclaimer, the term of this patent is extended or adjusted under 35 U.S.C. 154(b) by 66 days.

(21) Appl. No.: 14/765,687

(22) PCT Filed: Jan. 29, 2014

(86) PCT No.: PCT/EP2014/051675
§ 371 (c)(1),
(2) Date: Aug. 4, 2015

(87) PCT Pub. No.: WO2014/122052
PCT Pub. Date: Aug. 14, 2014

(65) Prior Publication Data

US 2015/0369191 A1 Dec. 24, 2015

(30) Foreign Application Priority Data

Feb. 5, 2013 (AT) ..... 88/2013

(51) Int. Cl.
*F04B 53/16* (2006.01)
*F02M 59/44* (2006.01)
(Continued)

(52) U.S. Cl.
CPC ..... *F02M 59/44* (2013.01); *F02M 55/008* (2013.01); *F02M 59/02* (2013.01);
(Continued)

(58) Field of Classification Search
CPC .... F04B 53/16; F04C 2240/30; F04D 29/406; F04D 29/44; F02M 59/44; F02M 55/008;
(Continued)

(56) References Cited

U.S. PATENT DOCUMENTS 2,768,840 A * 10/1956 Coberly ..... F04B 47/04 137/594
8,608,093 B2 * 12/2013 Girlinger ..... F02M 55/005 123/468
(Continued)

FOREIGN PATENT DOCUMENTS

DE 19925380 12/2000
DE 102004018937 11/2005
(Continued)

OTHER PUBLICATIONS

International Search Report for Application No. PCT/EP2014/051675 dated May 30, 2014 (English Translation, 2 pages).

*Primary Examiner* — Marguerite McMahon
(74) *Attorney, Agent, or Firm* — Michael Best & Friedrich LLP

(57) ABSTRACT

In a component (1), in particular a housing of a high-pressure fuel pump, in which at least one first high-pressure channel (4) and one second high-pressure channel (5) are present, the longitudinal axis of the first channel (4) is at an acute or right angle to the longitudinal axis of the second channel (5), wherein the second channel (5) leads into the first channel (4), such that an intersection is formed. The first channel (4) is formed by a central bore (10) and at least one secondary bore (11) that enlarges the cross-section of the central bore (10), wherein the longitudinal axis of the secondary bore (11) and the longitudinal axis of the central bore (10) extend parallel to one another. The central bore (10) passes through ugh the component (1) and consists of a first segment (8) extending over the intersection and a second segment (9) connected to the first segment, wherein the at least one secondary bore (11) extends only along the first segment (8) and no secondary bore is provided along the second segment (9).

21 Claims, 3 Drawing Sheets

(51) Int. Cl.
*F02M 55/00* (2006.01)
*F02M 59/02* (2006.01)

(52) U.S. Cl.
CPC . *F02M 2200/03* (2013.01); *F02M 2200/8069* (2013.01); *F04B 53/16* (2013.01)

(58) Field of Classification Search
CPC ..... F02M 2200/8069; F02M 2200/03; F02M 59/02
USPC ..... 417/572; 138/111, 114, 115, 117
See application file for complete search history.

(56) References Cited

U.S. PATENT DOCUMENTS

| | | | | |
|---|---|---|---|---|
| 9,234,511 | B2 * | 1/2016 | Hopley | F02M 59/02 |
| 2008/0282879 | A1 * | 11/2008 | Arnold | F02M 59/44<br>92/169.1 |
| 2009/0120411 | A1 * | 5/2009 | Arnold | B23H 3/00<br>123/495 |
| 2012/0234403 | A1 * | 9/2012 | Hopley | F02M 59/02<br>137/343 |
| 2014/0157807 | A1 * | 6/2014 | Cogswell | F25B 41/00<br>62/115 |

FOREIGN PATENT DOCUMENTS

| | | |
|---|---|---|
| DE | 102008040383 | 1/2010 |
| EP | 0404407 | 12/1990 |
| EP | 0982493 | 3/2000 |
| JP | 2009068371 | 4/2009 |

* cited by examiner

COMPONENT HAVING HIGH-PRESSURE BORES THAT LEAD INTO ONE ANOTHER

BACKGROUND OF THE INVENTION

The invention relates to a component, in particular to a housing of a high-pressure fuel pump, in which at least one first high-pressure channel and one second high-pressure channel are present, the longitudinal axis of the first channel being at an acute or right angle to the longitudinal axis of the second channel and the second channel leading into the first channel such that an intersection is formed, wherein the first channel is formed by a central bore and at least one secondary bore that enlarges the cross-section of the central bore, wherein the longitudinal axis of the secondary bore and the longitudinal axis of the central bore extend parallel to one another.

Such a component is, for example, known as a housing of a piston pump of a fuel system. By means of said piston pump, the fuel is compressed to a very high pressure and pressed into a fuel high-pressure accumulator, in particular into a fuel collecting line ("fuel rail") or into integrated accumulators of accumulator injectors. The fuel is stored there under very high pressure. A plurality of injection valves are connected to the fuel rail, the injection valves injecting the fuel directly into the respective combustion chambers associated with said injection valves.

In the known components of this type, the fuel is compressed in conveying chambers, which are present in the housing, by corresponding pistons. The highly compressed fuel from the individual conveying chambers arrives at a common outlet, the so-called pump collector, via flow channels, which are introduced into the housing or into housing parts of the high-pressure fuel pump in the form of bores. Out of each conveying chamber, a flow channel or, respectively, bore leads into the pump collector, wherein the flow channels are at an angle >0° with respect to the pump collector. A bore intersection is formed in each case at the interface of the flow channels with the pump collector.

Due to the pressure of up to 2,200 bar prevailing in the components of fuel injection systems subjected to high-pressure, stresses occur in the pipes and channels carrying the mediums. In the pipes, axial stresses, radial stresses and stresses in the circumferential direction occur, from which the stresses in the circumferential direction make up the largest proportion of the pipe stresses. Particularly high stresses in the form of tensile stresses in the material occur at the bore intersections, in particular in the case of acute angles, on account of the overlap of the stresses from the two or plurality of bores. The maximum stress is achieved directly at the intersection edge. These locations are particularly prone to breakage when the pressures are not constant, i.e. with a pulsating load. It is therefore primarily necessary to reduce the circumferential stresses.

In this connection, it has already been proposed to enlarge the cross-section of the first channel at least in the region where the second channel leads into the same by introducing at least one, in particular two, secondary bore(s) that enlarge (s) the cross-section of the central bore. If the longitudinal axes of the secondary bores and the central bore enclose in each case an acute angle with each other, this is referred to as a "fan intersection" or a "telescope intersection". The longitudinal axes of the central bore and the secondary bores converge hereby in the direction towards a high pressure connection of the first channel. The disadvantage of this configuration is the fact that the central bore and the secondary bores each have to be bored from both sides of the component, which leads to a high sensitivity with respect to manufacturing tolerances and to high costs.

SUMMARY OF THE INVENTION

It is thus the aim of the invention to reduce the cost and effort for the intersection at the first channel without compromising the advantages existing with regard to the stress level.

In order to meet this aim, the invention substantially provides in the case of the component of the aforementioned type that the central bore passes through said component and consists of a first segment extending over the intersection and a second segment connected to the first segment, and that the at least one secondary bore extends only along the first segment and no bore is provided along the second segment. Due to the fact that the central bore is drilled through, the number of bores to be drilled is reduced. The first segment and the second segment of the central bore, which align which each other, are thus formed in a single production step. The cross-sectional enlargement of the first channel is implemented in the region of the intersection, i.e. in the region where the at least one second channel leads into said first channel, by virtue of the fact that at least one secondary bore is formed along the first segment of the central bore, wherein the secondary bore does not extend through the component but is designed as a blind hole. In the design according to the invention, it is therefore sufficient to bore the at least one secondary bore only from one side of the component; thus enabling the total number of bores to be drilled to be substantially reduced.

A particularly low-stress design results according to a preferred modification if respectively one secondary bore that enlarges the cross-section of the central bore is formed on both sides of the central bore. In this instance, the longitudinal axes of the central bore and the two secondary bores preferably lie in a common plane.

The at least one secondary bore can have the same bore diameter as the central bore. As an alternative, it is also conceivable for the at least one secondary bore to have a smaller bore diameter than the central bore.

In any case, the provision of secondary bores leads advantageously to the cross-sectional area of the first channel being larger than the cross-sectional area of the second channel. In particular, the cross-sectional area of the second channel can substantially correspond to the cross-sectional area of the central bore of the first channel.

In order to reduce the stress peaks at the intersection of the secondary bore end with the central bore, a preferred modification to the invention provides that the bore end of the at least one secondary bore is spherically designed or designed having a drill taper of, e.g., 120°-150°, in particular 140°.

In order to enable the lines carrying the high pressure medium to be connected in a simple manner, provision can furthermore be made for the central bore to have a high pressure connection comprising an outwardly diverging, conical sealing surface at the end of the second segment.

A preferred application of the present invention consists of the first channel being a collector bore of a high-pressure piston pump, in particular a radial piston pump of a fuel injection systems of an internal combustion engine.

BRIEF DESCRIPTION OF THE DRAWINGS

The invention is explained below in detail with the aid of the exemplary embodiments that are schematically depicted in the drawings. In the drawings.

DETAILED DESCRIPTION

Figure 1:
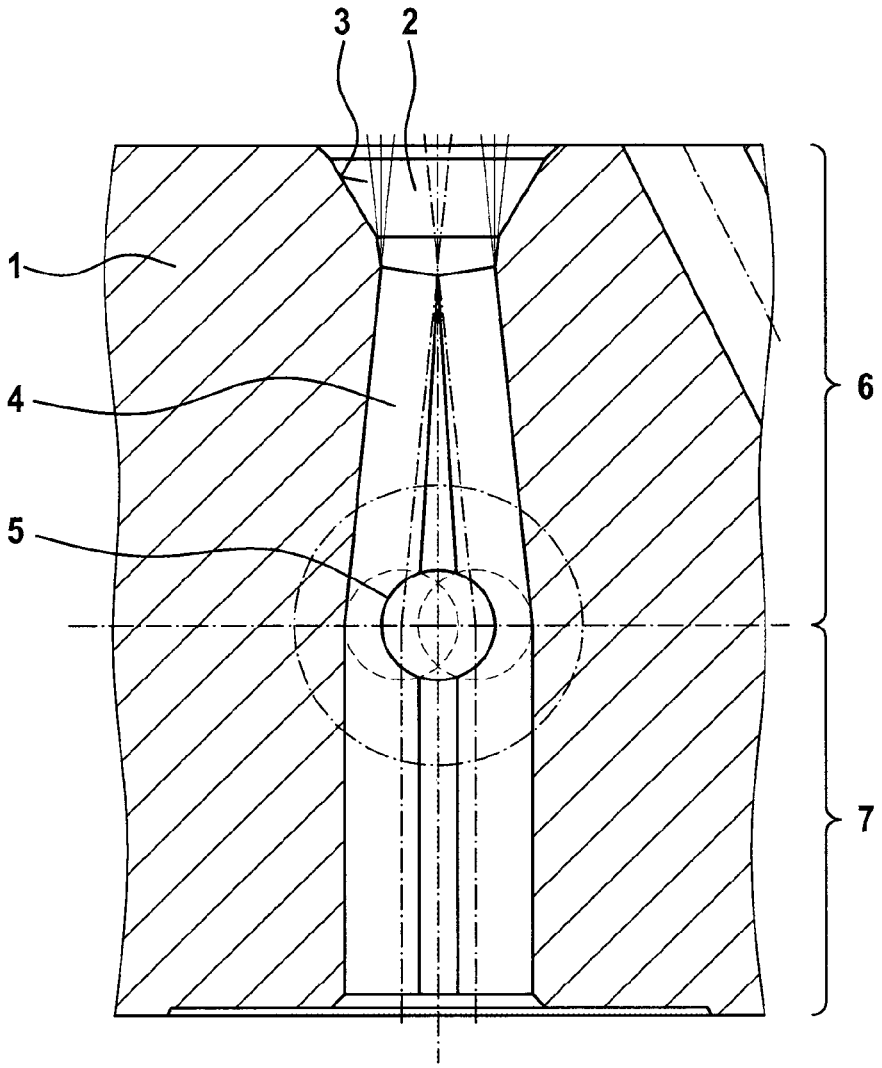
Fig. 1 (PRIOR ART)
FIG. 1 shows a design of a so-called fan intersection according to the prior art.

In FIG. 1, a component 1 carrying a high-pressure medium is shown in accordance with the prior art, e.g. a housing of a high-pressure fuel pump of a fuel injection system of an internal combustion engine. The component 1 comprises a high-pressure connection 2 which has a conical sealing surface 3 that can interact with a corresponding mating surface of the connection pipe. The high-pressure connection 2 leads to a first channel 4 which is designed as a bore in the housing 1. A second channel 5, which is likewise designed as a bore, leads at a right angle into the first channel 4. In order to achieve a cross-sectional enlargement in the region of the intersection between the first channel 4 and the second channel 5, the first channel 4 is formed from a central bore and two secondary bores that are disposed on both sides of the central bore and enlarge the cross-section of said central bore. The axes of the secondary bores extend at an acute angle with respect to the axis of the central bore in a segment 6, which extends from the high-pressure connection 2 to the axis of the second channel 5; so that a fan-shaped arrangement results. The axes of the secondary bores extend parallel to the axis of the central bore in a segment 7 which directly connects to the segment 6. The bores of the first segment 6 and the bores of the second segment 7 are bored from opposite sides of the component 1. In the embodiment according to FIG. 1, a total of six bores are therefore required. Hence, this design is cost intensive and sensitive to manufacturing tolerances.

Figure 2:
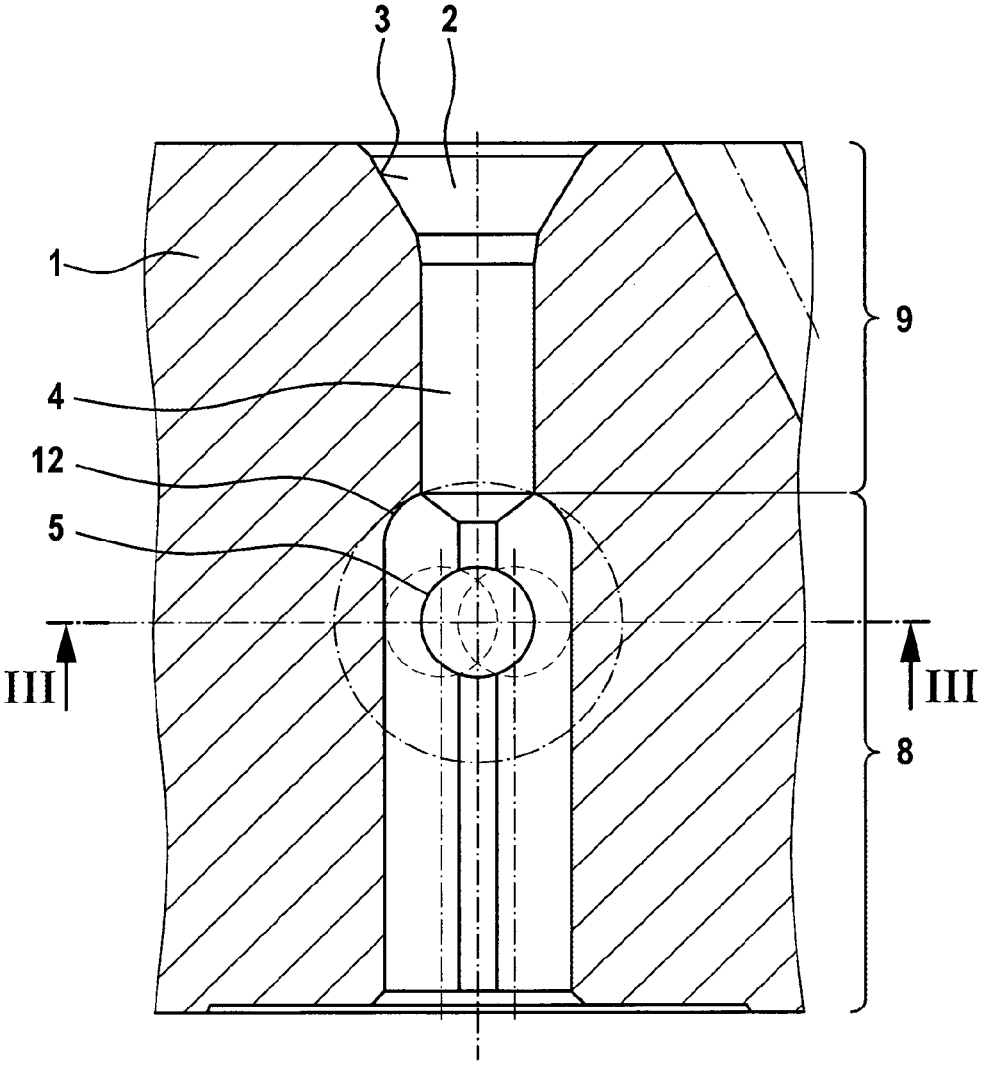
FIG. 2 shows a design according to the invention in a first sectional view.
Figure 3:
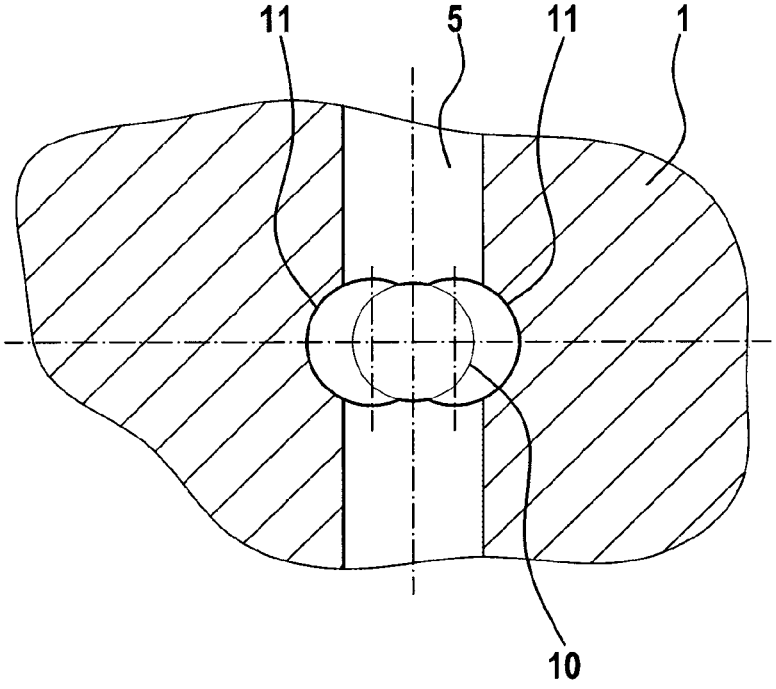
FIG. 3 shows the design according to FIG. 2 in a sectional view along the line III-III of FIG. 2.

In the inventive design according to FIG. 2, only three bores are, however, necessary without the stress level in the region of the intersection being negatively impacted. The first channel 4 has a first segment 8 and a second segment 9 which directly join each other. The first segment 8 thereby extends over the intersection of the second channel 5 with the first channel 4, so that the intersection completely lies in the first segment 8. The first channel 4 is only formed by the central bore 10 in the second segment 9, whereas the first channel 4 is formed by the central bore 10 and the secondary bores 11 in the first segment 8, as can be seen particularly in the cross-sectional view according to FIG. 3. The secondary bores 11 can be machined at the end 12 thereof with the aid of a spherical head in order to obtain a corresponding curved end surface.

The invention claimed is:

1. A component comprising a first high-pressure channel and at least one second high-pressure channel, a longitudinal axis of the first channel being at an acute or right angle to a longitudinal axis of the second channel and the second channel leading into the first channel, such that an intersection is formed, wherein the first channel is formed by a central bore and at least one secondary bore that enlarges a cross-section of the central bore, a longitudinal axis of the secondary bore and a longitudinal axis of the central bore extending parallel to one another, characterized in that the central bore (10) passes through the component (1) and consists of a first segment (8) extending over the intersection and a second segment (9) connected to the first segment, and in that the at least one secondary bore (11) extends only along the first segment (8) and no secondary bore is provided along the second segment (9).

2. The component according to claim 1, characterized in that respectively one secondary bore (11) that enlarges the cross-section of the central bore (10) is formed on both sides of the central bore (10).

3. The component according to claim 2, characterized in that longitudinal axes of the central bore (10) and two secondary bores (11) lie in a common plane.

4. The component according to claim 1, characterized in that the at least one secondary bore (11) has the same bore diameter as the central bore (10).

5. The component according to claim 1, characterized in that the at least one secondary bore (11) has a smaller bore diameter than the central bore (10).

6. The component according to claim 1, characterized in that a cross-sectional area of the first segment of the first channel (4) is greater than a cross-sectional area of the second channel (5).

7. The component according to claim 1, characterized in that a cross-sectional area of the second channel (5) substantially corresponds to a cross-sectional area of the central bore (10) of the first channel (4).

8. The component according to claim 1, characterized in that a bore end (12) of the at least one secondary bore (11) is spherically shaped.

9. The component according to claim 1, characterized in that the central bore (10) has a high-pressure connection (2), which comprises an outwardly diverging, conical sealing surface (3), at an end of the second segment (9).

10. The component according to claim 1, characterized in that the first channel (4) is a collector bore of a high-pressure piston pump.

11. The component according to claim 1, characterized in that a bore end (12) of the at least one secondary bore (11) is formed having a drill taper of 140°.

12. The component according to claim 1, characterized in that the first channel (4) is a collector bore of an inline piston pump or a radial piston pump of a fuel injection system of an internal combustion engine.

13. A housing of a high-pressure fuel pump, comprising a first high-pressure channel and at least one second high-pressure channel, a longitudinal axis of the first channel being at an acute or right angle to a longitudinal axis of the second channel and the second channel leading into the first channel, such that an intersection is formed, wherein the first channel is formed by a central bore and at least one secondary bore that enlarges a cross-section of the central bore, a longitudinal axis of the secondary bore and a longitudinal axis of the central bore extending parallel to one another, characterized in that the central bore (10) passes through the component (1) and consists of a first segment (8) extending over the intersection and a second segment (9) connected to the first segment, and in that the at least one secondary bore (11) extends only along the first segment (8) and no secondary bore is provided along the second segment (9).

14. The housing according to claim 13, characterized in that respectively one secondary bore (11) that enlarges the cross-section of the central bore (10) is formed on both sides of the central bore (10).

15. The housing according to claim 14, characterized in that longitudinal axes of the central bore (10) and two secondary bores (11) lie in a common plane.

16. The housing according to claim 13, characterized in that the at least one secondary bore (11) has the same bore diameter as the central bore (10).

17. The housing according to claim 13, characterized in that the at least one secondary bore (11) has a smaller bore diameter than the central bore (10).

18. The housing according to claim 13, characterized in that a cross-sectional area of the first segment of the first channel (4) is greater than a cross-sectional area of the second channel (5).

19. The housing according to claim 13, characterized in that a cross-sectional area of the second channel (5) substantially corresponds to a cross-sectional area of the central bore (10) of the first channel (4).

20. The housing according to claim 13, characterized in that a bore end (12) of the at least one secondary bore (11) is spherically shaped.

21. The housing according to claim 13, characterized in that the central bore (10) has a high-pressure connection (2), which comprises an outwardly diverging, conical sealing surface (3), at an end of the second segment (9).

* * * * *